US006193777B1

(12) United States Patent
Weinl et al.

(10) Patent No.: US 6,193,777 B1
(45) Date of Patent: Feb. 27, 2001

(54) TITANIUM-BASED CARBONITRIDE ALLOY WITH NITRIDED SURFACE ZONE

(75) Inventors: Gerold Weinl, Älvsjö ; Ulf Rolander, Stockholm; Per Lindahl, Lindome, all of (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/358,464

(22) Filed: Jul. 22, 1999

Related U.S. Application Data

(62) Division of application No. 09/075,247, filed on May 11, 1998, now Pat. No. 6,017,488.

(30) Foreign Application Priority Data

May 15, 1997 (SE) ..... 9701859

(51) Int. Cl.[7] ..... C22C 29/04

(52) U.S. Cl. ..... 75/238; 75/242; 51/307; 407/119

(58) Field of Search ..... 75/237, 238, 242; 51/307; 407/119

(56) References Cited

U.S. PATENT DOCUMENTS

| | | |
|---|---|---|
| 4,276,096 | 6/1981 | Kolaska et al. . |
| 4,447,263 | 5/1984 | Sugizawa et al. . |
| 4,985,070 | 1/1991 | Kitamura et al. . |
| 5,110,543 | 5/1992 | Odani et al. . |
| 5,336,292 | 8/1994 | Weinl et al. . |
| 5,577,424 | 11/1996 | Isobe et al. . |
| 5,694,639 | 12/1997 | Oskarsson et al. . |

FOREIGN PATENT DOCUMENTS

95/30030 11/1995 (WO) .

*Primary Examiner*—Ngoclan Mai
(74) *Attorney, Agent, or Firm*—Burns, Doane, Swecker & Mathis, L.L.P.

(57) ABSTRACT

An uncoated titanium-based carbonitride cutting tool insert with superior plastic deformation resistance and wear resistance is provided. This is accomplished by heat treating the material in nitrogen atmosphere under conditions to obtain a nitrogen rich surface zone, also containing substantial amounts of binder phase.

12 Claims, 3 Drawing Sheets

TITANIUM-BASED CARBONITRIDE ALLOY WITH NITRIDED SURFACE ZONE

This application is a divisional of application Ser. No. 09/075,247 , filed May 11, 1998, U.S. Pat. No. 6,017,488.

BACKGROUND OF THE INVENTION

The present invention relates to a liquid phase sintered body of a carbonitride alloy with titanium as main component which has improved properties particularly when used as cutting tool material in cutting operations requiring sharp edges in combination with high wear resistance and plastic deformation resistance. This has been achieved by heat treating the material in a nitrogen atmosphere.

Titanium-based carbonitride alloys, so-called cermets, are today well established as insert material in the metal cutting industry and are especially used for finishing. They comprise carbonitride hard constituents embedded in a metallic binder phase. The hard constituent grains generally have a complex structure with a core surrounded by a rim of other composition.

In addition to titanium, group VIa elements, normally both molybdenum and tungsten and sometimes chromium, are added to facilitate wetting between binder and hard constituents and to strengthen the binder by means of solution hardening. Group IVa and/or Va elements, i.e., Zr, Hf, V, Nb and Ta, are also added in all commercial alloys available today. All these additional elements are usually added as carbides, nitrides and/or carbonitrides. The grain size of the hard constituents is usually <2 $\mu$m. The binder phase is normally a solid solution of mainly both cobalt and nickel. The amount of binder phase is generally 3–25 wt %. Other elements are sometimes added as well, e.g., aluminum, which are said to harden the binder phase and/or improve the wetting between hard constituents and binder phase.

One main advantage with cermets compared to WC-Co-based material is that relatively high wear resistance and chemical inertness can be obtained without applying surface coatings. This property is utilized mainly in extreme finishing operations requiring sharp edges and chemical inertness to cut at low feed and high speed. However, these desirable properties are generally obtained at the expense of toughness and edge security as well as ease of production. The most successful materials have a large nitrogen content (N/(C+N) often exceeding 50%) which makes sintering in conventional processes difficult due to porosity caused by denitrification. The high nitrogen content also makes the material difficult to grind. Grinding may be necessary to obtain sharp defect free edges and close tolerances. Ideally, for extreme finishing operations, one would like to have an uncoated cermet with low to moderate nitrogen content for ease of production, but with a wear resistance essentially the same as PVD- or CVD-coated material.

U.S. Pat. No. 4,447,263 discloses inserts of a titanium-based carbonitride alloy provided with a wear resistant surface layer of carbonitride or oxycarbonitride alone or in combination where the surface layer is completely free from binder phase. The layer is obtained by a heat treatment at 1100–1350° C. in an atmosphere of $N_2$, CO and/or $CO_2$ at subpressure.

Another example is in U.S. Pat. 5,336,292 where the surface layer contains a low amount of binder phase but is separated from the interior of the material by a sharp interface to a binder phase enriched zone. The layer is obtained by heat treatment in an atmosphere of $N_2$ and/or $NH_3$ possibly in combination with at least one of $CH_4$, CO and $CO_2$ at 1100–1350° C. for 1–25 hours at atmospheric pressure or higher.

OBJECTS AND SUMMARY OF THE INVENTION

It is an object of this invention to avoid or alleviate the problems of the prior art.

It is further an object of the present invention to provide a sintered titanium-based carbonitride alloy, which has been heat treated to obtain a 5–60 $\mu$m thick surface zone with high nitrogen content. The heat treatment is performed as a process step included in the cooling part of the sintering cycle or as a separate process, e.g., as last production step, after any optional grinding operation has been performed.

In one aspect of the invention, there is provided a cutting tool insert of sintered titanium-based carbonitride alloy containing hard constituents based on Ti, Zr, Hf, V, Nb, Ta, Cr, Mo and/or W in a cobalt binder phase wherein said alloy has a 5–60 $\mu$m thick nitrogen enriched surface zone and a Co content at the surface in the range 50–150% of the nominal Co value in the insert as a whole.

In another aspect of the invention, there is provided a method of manufacturing a sintered body of titanium-based carbonitride alloy, containing hard constituents based on Ti, Zr, Hf, V, Nb, Ta, Cr, Mo and/or W in a cobalt binder phase comprising liquid phase sintering followed by a nitriding process said nitriding being performed at a temperature of 1150–1250° C. in an atmosphere comprising 500–1500 mbar nitrogen gas for 1–40 hours.

DETAILED DESCRIPTION OF THE PREFERRED EMBODIMENTS OF THE INVENTION

Figure 1:
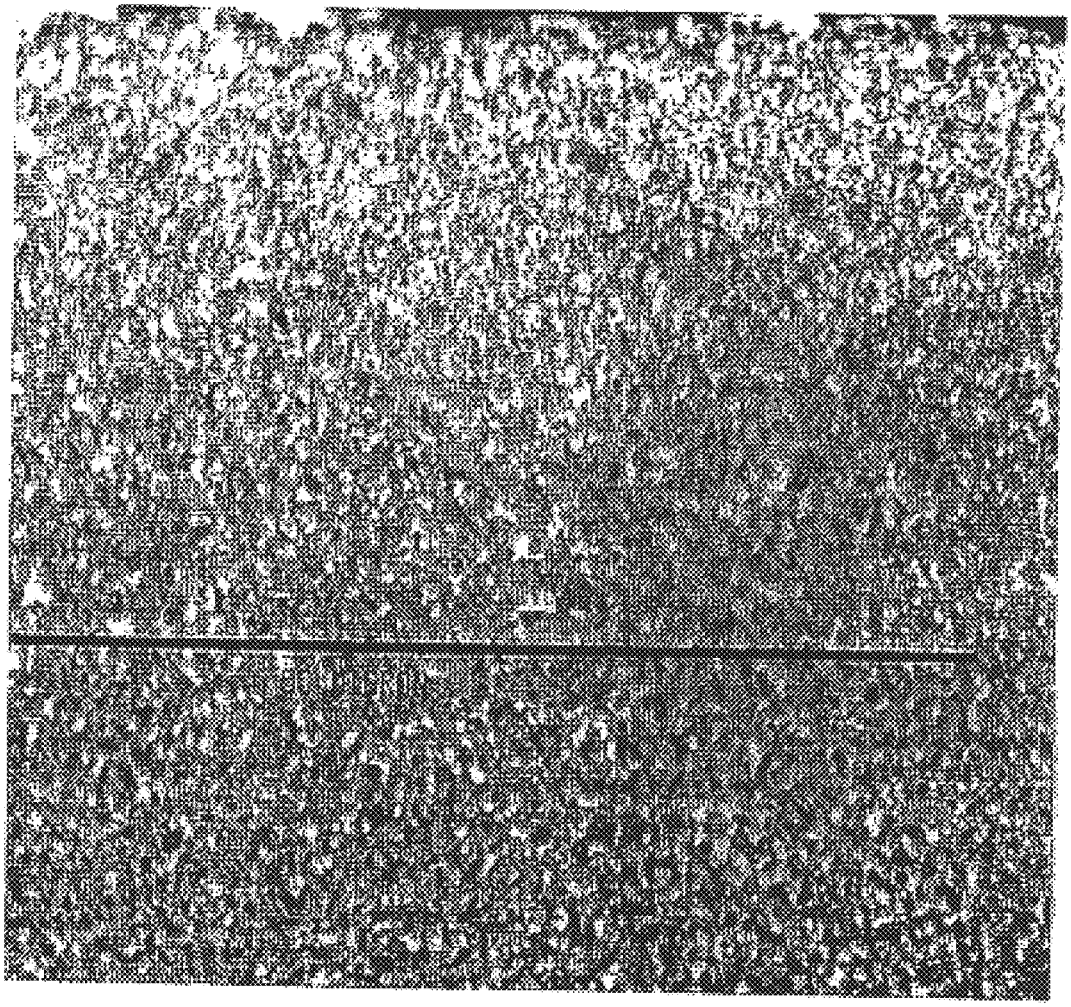
FIG. 1 is a photomicrograph (2000X) showing a portion of an insert of the present invention.

The sintered titanium-based carbonitride alloy of the present invention containing 2–15 atomic %, preferably 2–6 atomic %, tungsten and/or molybdenum. Apart from titanium, the alloy contains 0–15 atomic % of group IVa and/or group Va elements, preferably 0–5 atomic % tantalum and/or niobium. As the binder phase forming element 5–25 atomic %, preferably 9–16 atomic % cobalt is added. The alloy has a N/(C+N) ratio in the range 10–60 atomic %, preferably 10–40 atomic %. Most preferably no elements apart from C, N, Ti, W, Ta and Co are intentionally added.

In a 5–60 $\mu$m, preferably 15–50 $\mu$m, most preferably 20–40 $\mu$m, thick surface zone, the nitrogen content increases towards the surface. This enrichment is mainly due to the presence of TiN grains formed during heat treatment and can be identified by X-ray diffraction. These TiN grains may grow separately but can also grow epitaxially, forming an outer shell at least partly surrounding carbonitride grains. Furthermore, the nitrogen enriched zone has a binder phase content being approximately the same as in the bulk and being distributed all the way out to the surface. The Co content at the surface is 50–150%, preferably 75–130%, most preferably 90–125%, of the bulk value, that is, the nominal value of Co in the alloys as a whole, depending on whether any Co gradient towards the surface was present in the material prior to heat treatment. Thus, the enriched zone is not a coating and not an essentially binder phase-free, hard phase layer. In an alternative embodiment the Co-content in the surface zone is essentially the same as in the inner part of the body. In an X-ray diffractogram of the surface, Ti containing hard phase is seen as two distinct peaks, one peak originating from TiN, the other peak originating from mixed cubic carbonitride phase. The intensity ratio TiN(200)/TiCN (200) shall be >0.5, preferably >1, most preferably >1.5. In the same diffractogram is also seen a distinct peak originating from Co-based binder phase.

The alloy must not contain nickel and/or iron apart from inevitable impurities (e.g., 0.5% max). With higher levels of these binder forming elements, the desired microstructure cannot be produced. Instead an essentially binder phase free hard phase surface layer is formed. Such layers have been presented by previous inventors as an alternative to expensive coating operations but have inferior properties compared to CVD- and PVD coatings.

In another aspect of the invention, there is provided a method of manufacturing a sintered carbonitride alloy in which powders of carbides, carbonitrides and/or nitrides are mixed with Co to a prescribed composition and pressed into green bodies of desired shape. The green bodies are liquid phase sintered in vacuum or a controlled gas atmosphere at a temperature in the range 1370–1500° C., preferably using the technique described in U.S. Ser. No. 09/075,221 filed concurrently herewith corresponding to Swedish Application No. 9701858-4) U.S. Pat. No. 5,976,213. Either directly upon cooling from the sintering temperature or as a separate process, the inserts are heat treated at a temperature of 1150–1250° C. in an atmosphere comprising 500–1500 mbar, preferably 1000–1500 mbar, nitrogen gas for 1–40 hours, preferably 10–25 hours.

It has quite surprisingly turned out that, for the compositions specified above, nitrification can be used to enhance chemical inertness, wear resistance and plastic deformation resistance of cermet without obtaining a hard phase surface layer. The reason is that in a Co-based binder phase and at relatively high nitrogen pressures in the furnace, nitrogen diffusion from the surface is distinctly faster than titanium diffusion. For this reason TiN is nucleated inside the material rather than at the surface. The rate of TiN formation at a given depth from the surface is determined by the nitrogen activity at that depth. Ti is most probably taken predominantly from the rims of the hard phase grains. Thus the rims are dissolved at least to some extent, leading to decreased grain size. Excess group V and group VI elements from the rims diffuse away from the surface and reprecipitate on existing hard phase grains in the interior of the material. Due to this latter process, a slight binder phase enrichment of the nitrided surface zone may occur, at least with longer process times. If this is not desirable, it can be counteracted by forming a moderate binder phase depletion in the surface zone of the insert prior to heat treatment. This is preferably done using the technique described in the patent application cited above. As soon as any appreciable amount of Ni or Fe is added to the alloy, the solubility of titanium in the binder phase increases dramatically. This, in turn, increases the diffusion rate of titanium and a hard phase surface layer will form instead.

Since the process is controlled by reactive gases in the sintering atmosphere, it is a definite advantage to place the inserts on a surface which is inert to this atmosphere. One good example of this is yttria coated graphite trays, as described in WO 97/40203, which corresponds to U.S. Ser. No. 08/837,094 U.S. Pat. No. 5,993,970, herein incorporated by reference.

The invention is additionally illustrated in connection with the following Examples which are to be considered as illustrative of the present invention. It should be understood, however, that the invention is not limited to the specific details of the Examples.

EXAMPLE 1

A powder mixture with a chemical composition of (atomic %) 40.7% Ti, 3.6% W, 30.4% C 13.9% N and 11.4% Co was manufactured from Ti(C,N), WC and Co raw material powders. The mean grain size of the Ti(C,N) and WC powders were 1.4 $\mu$m. The powder mixture was wet milled, dried and pressed into green bodies of the insert type TNMG 160408-PF. The bodies were liquid phase sintered at 1430° C. for 90 minutes in a 10 mbar Ar atmosphere. In the sintering process, the technique with reversed melting, where the liquid binder phase forms in the center and propagates outwards towards the surface was used to obtain a macroscopic Co-gradient through the material, the Co-content in the surface being 85% of that in the center of the alloy. This process is described in U.S. Ser. No. 09/075,221 filed concurrently herewith corresponding to Swedish Application No. 9701858-4) U.S. Pat. No. 5,976,213. In the cooling part of the process, a nitriding step was included where the bodies were heat treated in 1013 mbar nitrogen gas at 1200° C. for 20 hours.

Figure 2:
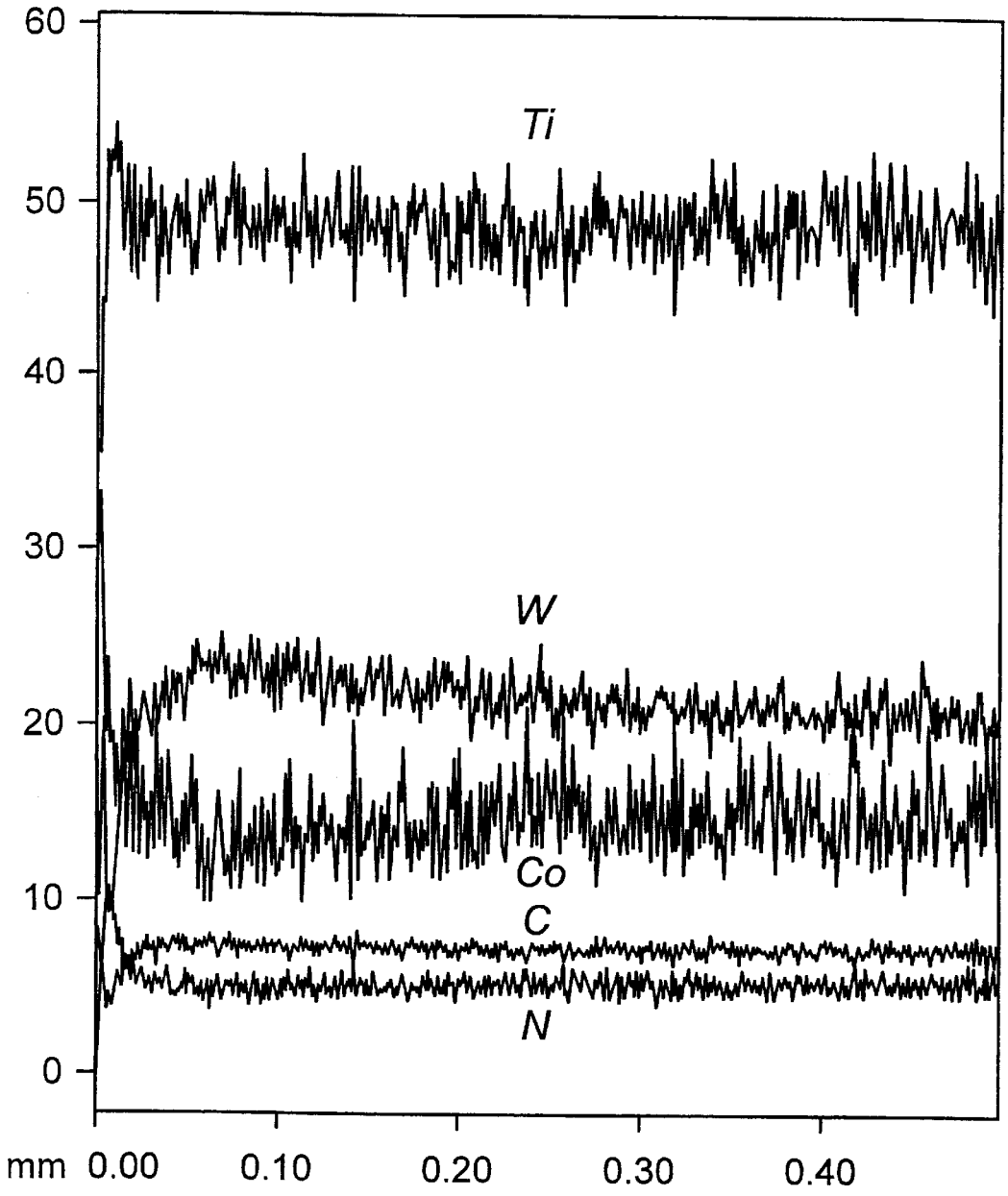
FIG. 2 is an EMPA (Electron Microprobe Analysis) line scan of Co, N, W, Ti and C in a portion of an insert of the present invention.
Figure 3:
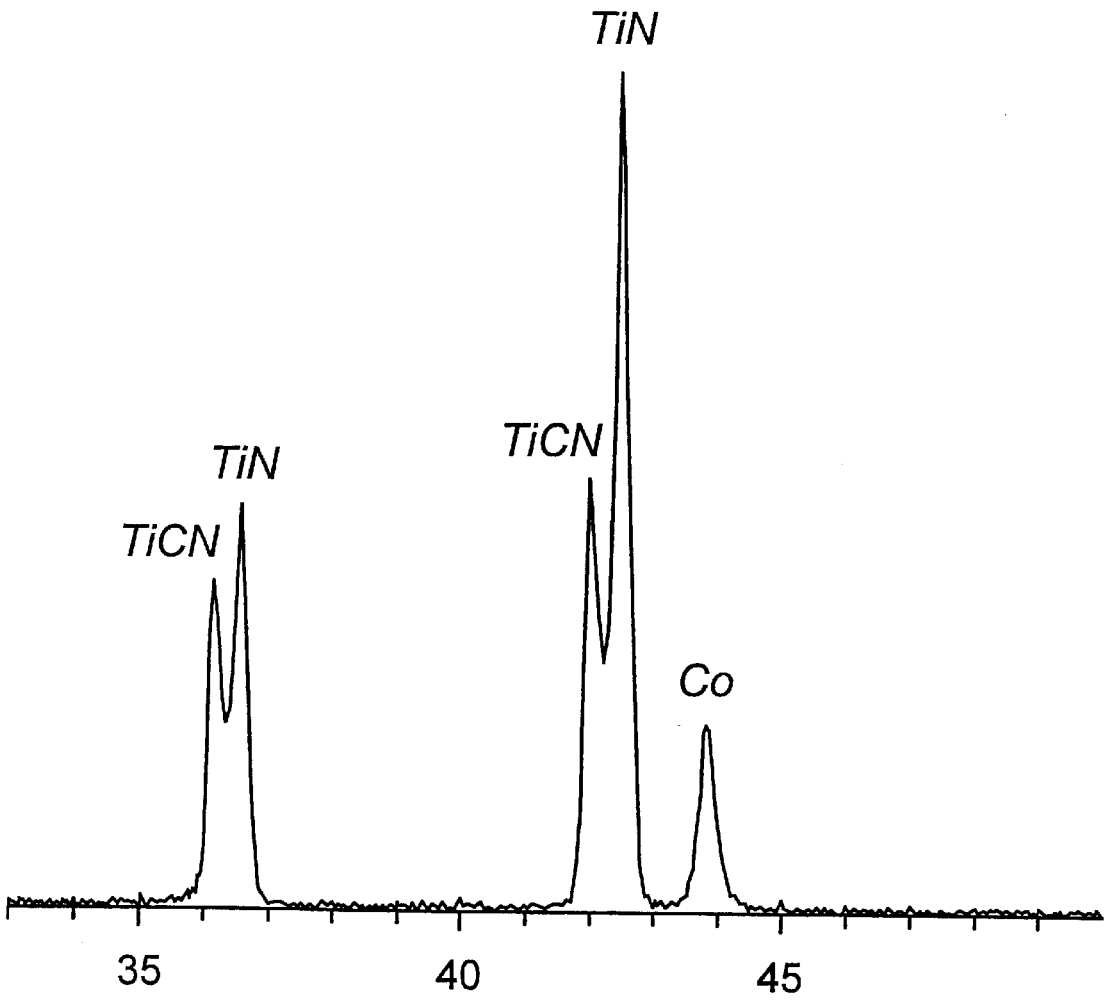
FIG. 3 is an X-ray diffractogram of the heat treated surface of an insert of the present invention.

Polished cross-sections of the inserts were prepared by standard metallographic techniques and characterised using optical microscopy and electron microprobe analysis (EMPA). Optical microscopy showed that the inserts had a golden to bronze colored, approximately 40 $\mu$m thick surface zone, FIG. 1. FIG. 2 shows an EMPA line scan analysis of Co, N, W, Ti and C ranging from the surface and 500 $\mu$m into the material. Clearly, in an approximately 30 $\mu$m thick surface zone, the nitrogen content increases substantially towards the surface, the Ti content increases while the W- and C content decreases. In the same zone, the cobalt content increases and reaches approximately 125% of the bulk content at the surface. FIG. 3 shows an X-ray diffractogram of the heat treated surface. Clearly, the Ti-based hard phase gives rise to two distinct series of peaks, one originating from TiN with an intensity being approximately twice that of the other, which originates from a carbonitride phase. Co peaks are also present in the diffractogram.

EXAMPLE 2 (Comparative)

As a reference for performance testing, TNMG160408-PF inserts were manufactured of a powder mixture consisting of (in atomic-%) Co 8.3, Ni 4.2, Ti 34.8, Ta 2.5, Nb 0.8, W 4.2, Mo 2, C 26.6 and N 16.6 and liquid phase sintered in a conventional process. These inserts were coated with an about 4 $\mu$m thick Ti(C,N)-layer and a less than 1 $\mu$m thick TiN-layer using the physical vapor deposition technique (PVD). This is a well established PVD-coated cermet grade within the P25-range for turning.

EXAMPLE 3

A longitudinal turning operation was carried out to study the wear resistance and plastic deformation resistance of the inserts of Examples 1 and 2. Tool life criterion was edge fracture due to plastic deformation or flank wear exceeding 0.3 mm. One test was carried out with cooling to test mainly wear resistance. The second test was performed without cooling to test mainly plastic deformation resistance. The time needed to reach the end of tool life was measured for each cutting edge. In each test, three edges per variant were tested. The speed was 275 m/min, the feed 0.2 mm/revolution, the depth of cut was 2 mm and the work piece material was SS2541. The result is given in the Table below.

| Coolant | PVD-coated | Heat treated |
|---|---|---|
| yes | 19 | 39 |
| no | 14 | 32 |

Comparing the results, it is clear that the nitriding process dramatically improves both wear resistance and plastic deformation resistance. It should be noted that uncoated inserts manufactured according to Example 1, excluding the nitriding step are not meaningful to include in this test. Even with coolant, their plastic deformation resistance would not be sufficient to withstand more than 1–3 minutes.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A sintered titanium-based carbonitride alloy containing hard constituents based on Ti, Zr, Hf, V, Nb, Ta, Cr, Mo and/or W in a cobalt binder phase, wherein said alloy has a 5–60 μm thick nitrogen enriched surface zone having a binder phase content approximately the same as the sintered alloy as a whole, and a Co content at the surface in the range 50–150% of the nominal Co value in the sintered alloy as a whole.

2. The sintered alloy of claim 1, wherein said alloy has a 15–50 μm thick nitrogen enriched surface zone and a Co content at the surface in the range of 75–130% of the nominal Co value in the sintered alloy as a whole.

3. The sintered alloy of claim 1 wherein said alloy has a 20–40 μm thick nitrogen enriched surface zone and a Co content at the surface in the range of 90–125% of the nominal Co value in the sintered alloy as a whole.

4. The sintered alloy of claim 1 wherein an X-ray diffractogram of the surface contains 2 sets of peaks originating from Ti-based hard phase and one set of peaks originating from a Co-based binder phase, the intensity ratio TiN(200)/TiCN(200) is >0.5.

5. The sintered alloy of claim 4 wherein the intensity ratio TiN(200)/TiCN(200) is >1.

6. The sintered alloy of claim 4 wherein the intensity ratio TiN(200)/TiCN(200) is >1.5.

7. The sintered alloy of claim 1 wherein the alloy contains apart from inevitable impurities in addition to titanium, 2–15 atomic % tungsten and/or molybdenum, 0–15 atomic % of group IVa and/or group Va elements apart from titanium, tungsten and/or molybdenum, 5–25 atomic % cobalt and with an average N/(C+N) ratio in the range 10–60 atomic %.

8. The sintered alloy of claim 7 wherein the alloy contains apart from inevitable impurities in addition to titanium, 2–7 atomic % tungsten and/or molybdenum, 0–5 atomic % of tantalum and/or niobium, 9–16 atomic % cobalt and with an average N/(C+N) ratio in the range 10–40 atomic %.

9. A cutting tool made, at least in part, from the sintered alloy of claim 1.

10. A cutting tool insert made, at least in part, from the sintered alloy of claim 1.

11. The sintered alloy of claim 1, wherein said sintered alloy is shaped as a cutting tool insert.

12. The sintered alloy of claim 1, wherein said alloy contains no more than 0.5 atomic % nickel and/or iron.

* * * * *